United States Patent [19]

Hansford et al.

[11] Patent Number: 5,052,938

[45] Date of Patent: Oct. 1, 1991

[54] THROUGH-WALL CONNECTION ASSEMBLY

[75] Inventors: Stuart M. Hansford, Warrington; Robert Dobson, Bolton, both of England

[73] Assignee: British Nuclear Fuels plc, Warrington, England

[21] Appl. No.: 481,625

[22] Filed: Feb. 20, 1990

[30] Foreign Application Priority Data

Mar. 3, 1989 [GB] United Kingdom ..... 8904957

[51] Int. Cl.[5] ..... H01R 13/44; H01R 13/60

[52] U.S. Cl. ..... 439/131; 439/544

[58] Field of Search ..... 439/131, 310, 374, 378, 439/380, 542, 544–546, 562, 572, 573, 624

[56] References Cited

U.S. PATENT DOCUMENTS 4,451,103 5/1984 Buresh et al. ..... 439/544

4,551,577 11/1985 Byrne ..... 439/131

FOREIGN PATENT DOCUMENTS 218595 12/1961 Australia ..... 439/544

*Primary Examiner*—Paula A. Bradley

*Attorney, Agent, or Firm*—William R. Hinds

[57] ABSTRACT

A through-wall connection assembly comprises a shield plug extending through a wall or barrier and slidable for axial displacement preferably by being located in a tubular liner. A housing mounted on the wall or barrier receives an end of the shield plug. The housing contains a removable carrier for a first connector part which is releasably engageable with a corresponding second connector part at the end of the shield plug.

4 Claims, 1 Drawing Sheet

THROUGH-WALL CONNECTION ASSEMBLY

BACKGROUND OF THE INVENTION

The present invention concerns a through-wall connection assembly. In particular the invention concerns an assembly for providing a releasable connection with apparatus or equipment located within a cell for radioactive materials and without breaking the containment or shielding of the cell.

FEATURES AND ASPECTS OF THE INVENTION

According to the present invention a through-wall connection assembly comprises a liner extending through the width of a wall or barrier and a shield plug slidably mounted for axial displacement in the liner, a housing mounted on the wall or barrier to receive the leading end of the shield plug, the housing containing a releasable carrier for a connector, the connector being releasably cooperable with and interengageable with a corresponding connector part at the lading end of the shield plug.

Also according to the present invention, a through-wall connection assembly comprises a shield plug extending through and axially displaceable in a wall or barrier, a housing mounted on the wall or barrier to receive the end of the shield plug, a removable carrier insertable in the housing, a first connector part in the carrier, a corresponding second connector part at the end of the shield plug releasably engageable with the first connector part in the carrier, and a peg on the carrier cooperable with a lug on the housing to establish correct alignment of the connector parts.

DESCRIPTION OF THE DRAWINGS

The invention will be described further, by way of example, with reference to the accompanying drawings; in which.

DESCRIPTION OF THE PREFERRED EMBODIMENTS

Figure 1:
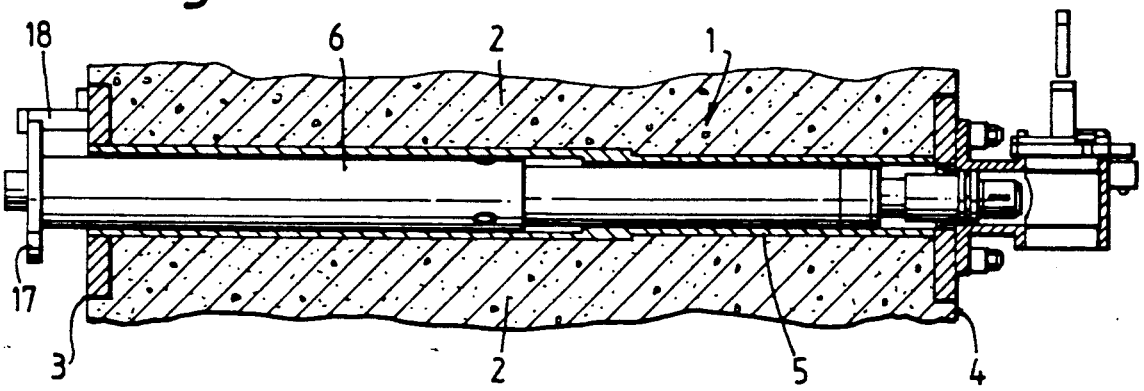
FIG. 1 is a overall view of an embodiment of a through-wall connection assembly when in a position of use.

A through-wall connection assembly 1 extends through a wall 2 which can, for example, be a wall of a containment or cave for radioactive material. The assembly 1 permits communication between the outer and inner sides of the wall, 3 and 4 respectively, and in the illustrated embodiment the assembly serves to transmit electrical power to equipment within the shielded containment.

The assembly 1 comprises a through wall tubular liner 5 and a shield plug 6, both the liner and the shield plug being stepped as shown at approximately mid-length positions. A housing 7 is secured by bolts 8 to the inner flange of liner 5 and in alignment with the liner and plug. The housing 7 supports a carrier 9.

The shield plug 6 comprises a steel tube filled with a shielding material such as concrete. At its leading end, that is the end directed to the interior of the containment, the shield plug carries a male part 10 of a multi-pin electrical connector. A multi-core electrical cable 12 extends from the part 10 through a conduit 11 in the plug 6 to a junction box at the opposite end of the plug.

An O-ring seal 13 is provided about the leading end of the shield plug to engage the bore of the housing 7.

The carrier 9 includes a female part 14 of the multi-pin electrical connector. The carrier 9 sits in a vertically orientated bore in the housing 7 and a peg 15 on the carrier cooperates with a bore in a lug 16 on the exterior of the housing 7 and ensures that the opening in the carrier 9 for the part 14 of the connector is in alignment with the liner and shield plug and hence the connector part 10. Further, the part 14 is resiliently mounted within the carrier 9 to accommodate any small misalignments.

Figure 2:
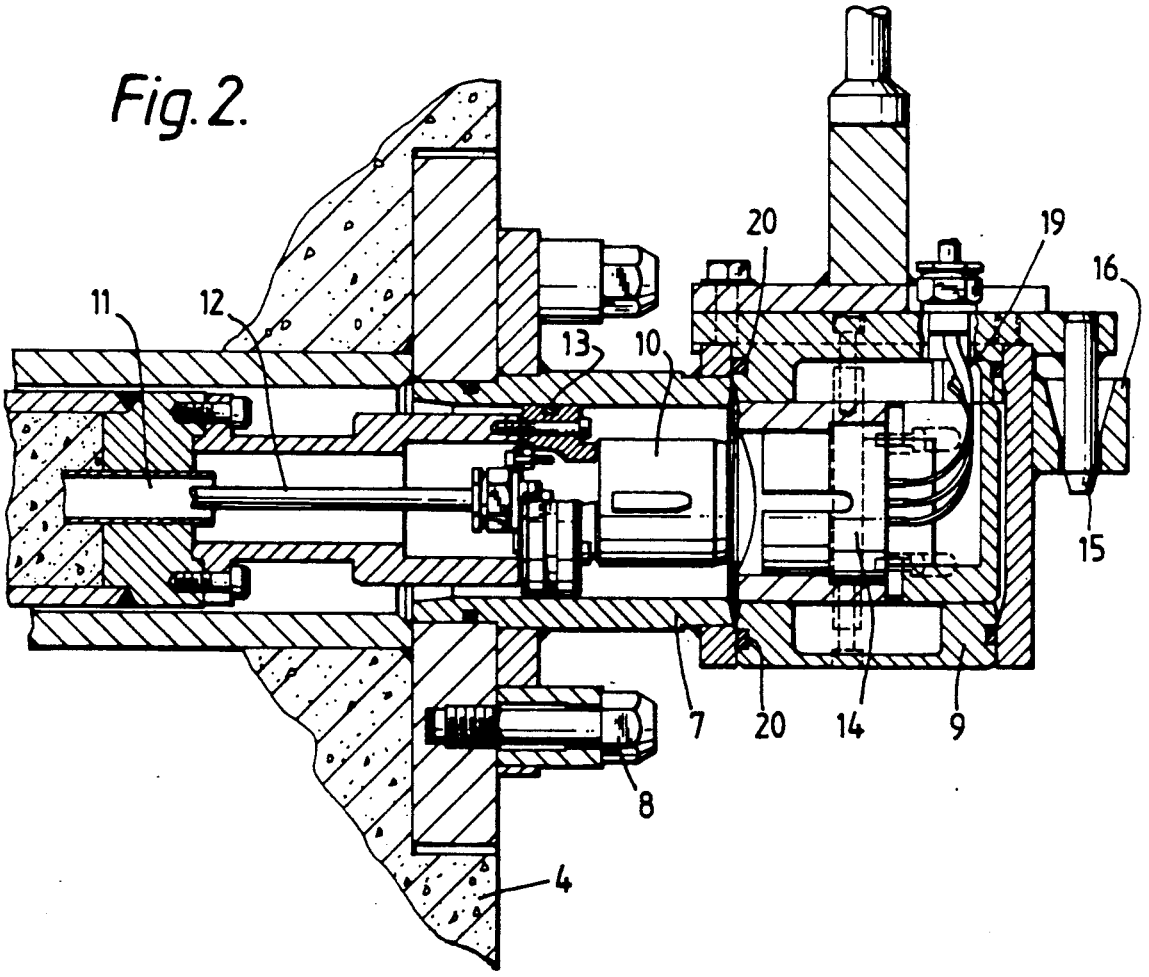
FIG. 2 is a section, to an enlarged scale, of a portion of the through-wall assembly.

The shield plug 6 is slidable within the liner 5 and in FIGS. 1 and 2 the parts 10 and 14 of the electrical connector are shown disengaged. In this position a flange 17 at the outer end of the plug 6 engages a stop 18 on the outer side 3 of the wall 2. When the shield plug is advanced the flange 17 abuts against the outer side of the wall 2 to arrest further movement of the shield plug 6 and in this position the part 10 fully engages the part 14 of the connector. The parts 10 and 14 can constitute for example a bayonet type connection. A multi-core cable 19 from the part 14 runs through the carrier 9 to terminate in electrical equipment, for example electric lights, within the shielded region contained by the wall 2.

The assembly provides a means for releasing and changing electrical connections within the shielded region and without breach of the containment or shielding. When the shield plug 6 is withdrawn against the stop 18 the carrier 9 can be removed from the housing 7 thereby facilitating the release of in-cell electrical equipment. In this position the shield plug 6 maintains the cell containment and shielding. By providing means to allow the flange 17 to disengage the stop 18 it is possible also to remove the shield plug 6 from the liner 5 whilst maintaining nominal containment provided that the carrier 9 is in position in its housing 7. The carrier 9 acts as a barrier to prevent escape from the interior of the cell along the liner 5.

Although described with reference to an electrical connector it will be apparent that the invention is applicable to other forms of connectors. For example, reference can be made to pneumatic and hydraulic connectors such as air, water and oil. The connector is splash proof and is not affected by washing the cell interior. When the carrier 9 containing the plug 14 is removed it can be replaced by a dummy carrier inserted into the housing 7 to maintain cleanliness.

In a modification, additional sealing rings 20 can be provided on the carrier 9 to engage the housing 7. Such sealing rings 20 ensure complete containment upon removal of the shield plug 6 and also makes the electrical connection area watertight. However, in such an arrangement it is desirable to include an air bleed path (not shown) through the shield plug 6 and extending from the end of the shield plug adjacent the connector part 10 to the opposite outer end of the shield plug 6.

The air bleed can follow a convoluted path in traversing the shield plug 6. The air bleed path serves to prevent pressure differences in the region about the connector part 10.

We claim:

1. A through-wall connection assembly comprising a shield plug extending through and axially displaceable in a wall or barrier, a housing mounted on the wall or barrier to receive an end of the shield plug, a removable carrier insertable in the housing, a first connector part in the carrier, a corresponding second connector part at the end of the shield plug releasably engageable with the first connector part in the carrier, and a tubular liner in the wall or barrier to receive the shield plug.

2. An assembly according to claim 1 in which the connector parts comprise an electrical plug and socket.

3. An assembly according to claim 1 including a stop cooperable with the shield plug to limit the extent of axial displacement of the shield plug.

4. A through-wall connection assembly comprising a shield plug extending through and axially displaceable in a wall or barrier, a housing mounted on the wall or barrier to receive an end of the shield plug, a removable carrier insertable in the housing, a first connector part in the carrier, a corresponding second connector part at the end of the shield plug releasably engageable with the first connector part in the carrier, and a peg on the carrier cooperable with a lug on the housing to establish correct alignment of the connector parts.

* * * * *